US007992954B2

(12) United States Patent
Kawabata

(10) Patent No.: US 7,992,954 B2
(45) Date of Patent: Aug. 9, 2011

(54) IMAGE FORMING APPARATUS CAPABLE OF INCREASING THROUGHPUT OF DUPLEX PRINTING

(75) Inventor: Kenichi Kawabata, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 698 days.

(21) Appl. No.: 11/901,197

(22) Filed: Sep. 13, 2007

(65) Prior Publication Data

US 2008/0062215 A1 Mar. 13, 2008

(30) Foreign Application Priority Data

Sep. 13, 2006 (JP) ..... 2006-247755

(51) Int. Cl.
*B41J 29/38* (2006.01)
*B41J 2/01* (2006.01)

(52) U.S. Cl. ..... 347/16; 347/101

(58) Field of Classification Search ..... None
See application file for complete search history.

(56) References Cited

U.S. PATENT DOCUMENTS

| | | | | |
|---|---|---|---|---|
| 6,719,469 | B2 * | 4/2004 | Yasui et al. | 400/603 |
| 7,396,123 | B2 | 7/2008 | Sootome et al. | |
| 7,506,948 | B2 | 3/2009 | Nonaka | |
| 7,591,458 | B2 | 9/2009 | Maki | |
| 7,621,632 | B2 | 11/2009 | Imoto et al. | |
| 2005/0270355 | A1 * | 12/2005 | Sootome et al. | 347/104 |
| 2007/0064032 | A1 | 3/2007 | Kawabata | |
| 2007/0120936 | A1 | 5/2007 | Kawabata | |

FOREIGN PATENT DOCUMENTS

| | | |
|---|---|---|
| JP | 2000-190481 | 7/2000 |
| JP | 2004-262557 | 9/2004 |
| JP | 2005-89713 | 4/2005 |
| JP | 2005-199691 | 7/2005 |
| JP | 2005-343167 | 12/2005 |
| JP | 2005-343636 | 12/2005 |
| JP | 2005-343637 | 12/2005 |
| JP | 2006-82546 | 3/2006 |
| WO | WO 2005108099 A1 * | 11/2005 |

OTHER PUBLICATIONS

Jan. 18, 2011 Japanese official action in connection with a counterpart Japanese patent application.

* cited by examiner

*Primary Examiner* — Omar Rojas
(74) *Attorney, Agent, or Firm* — Cooper & Dunham LLP

(57) ABSTRACT

An image forming apparatus operable in a duplex printing mode includes a liquid ejecting head, a conveyance member, a charger, and a controller. The liquid ejecting head ejects liquid droplets to respective first and second faces of a recording medium to form images thereon. The conveyance member conveys the recording medium while attracting the recording medium thereon by electrostatic force. The charger conduct a charging operation of the conveyance member to generate the electrostatic force. The controller is configured to control, based on a state of the first face having the image formed thereon, the charging operation during an image formation on the second face, and control a pause operation of a conveyance of the recording medium after the image formation on the second face.

19 Claims, 9 Drawing Sheets

IMAGE FORMING APPARATUS CAPABLE OF INCREASING THROUGHPUT OF DUPLEX PRINTING

TECHNICAL FIELD

The present disclosure relates generally to image forming apparatuses, and more specifically, to an image forming apparatus operable in a duplex print mode.

DISCUSSION OF RELATED ART

An image forming apparatus used as printer, facsimile machine, copier, plotter, or multi-functional device thereof may have a liquid ejecting device including a liquid ejecting head or recording head. Such an image forming apparatus ejects droplets of recording liquid from the liquid ejecting head to form a desired image on a sheet.

The term "sheet" used herein refers to a medium, a recorded medium, a recording medium, a sheet material, a transfer material, a recording sheet, a paper sheet, or the like. The sheet may also be made of material such as paper, string, fiber, cloth, leather, metal, plastic, glass, timber, and ceramic. Further, the term "image formation" used herein refers to providing, recording, printing, or imaging an image, a letter, a figure, a pattern, or the like to the sheet. Moreover, the term "liquid" used herein is not limited to recording liquid or ink, and may include anything ejected in the form of fluid. Hereinafter, such liquid may be simply referred to as "ink".

When such an image forming apparatus forms an image with ink on both sides of one sheet in a duplex or double-sided print mode, the sheet may be electrostatically attracted on a conveyance belt during an image forming operation. Such a conveyance belt may need to be charged at a given potential so that the sheet is securely attracted thereon to obtain images with preferable image quality. However, if the conveyance belt is charged at a greater potential, a relatively large amount of ink mist may be attracted and attached on the sheet during an image forming operation, thereby causing deterioration in image quality.

In view of such phenomenon, a conventional image forming apparatus sprays a liquid agent onto a sheet before an image forming operation to reduce charges on a surface of the sheet. Thus, such image forming apparatus attempts to suppress the above-described attachment of ink mist to the sheet. However, such image forming apparatus may need to include a specific ejection head and a container for such liquid agent. Therefore, such image forming apparatus may undesirably increase its size and manufacturing cost because of a complex structure for installing components for such liquid agent.

Further, in a duplex printing mode, the moisture content of a sheet may be increased after an image is formed with ink or other liquid on a first face of the sheet. Because of such increase in the moisture content, the sheet may not be securely attached to a conveyance belt.

In view of such phenomenon, another conventional image forming apparatus adjusts the voltage applied to the conveyance belt based on a volume of ink droplets recorded on a sheet. However, when the voltage is increased, an electric field of the conveyance belt may have greater effect on a recording head. Consequently, a relatively great amount of liquid or ink mist may be attached to the sheet, thereby causing deterioration in image quality.

Further, still another conventional image forming apparatus stops the conveyance of a sheet, having an ink image on a first face thereof, for some time until the ink image sufficiently dries. However, when such drying process is conducted for sheets having different printed states with an identical drying condition, the throughput (for example, the number of sheets to be printed in a given time period) of the image forming apparatus may be decreased, thereby reducing the productivity of the image forming apparatus.

BRIEF SUMMARY

The present disclosure provides an image forming apparatus capable of increasing the throughput of duplex printing while suppressing the attachment of liquid mist to a recording medium.

In an exemplary embodiment of the present disclosure, an image forming apparatus operable in a duplex printing mode includes a liquid ejecting head, a conveyance member, a charger, and a controller. The liquid ejecting head is configured to eject liquid droplets to respective first and second faces of a recording medium to form images on the respective first and second faces of the recording medium in order of the first face and the second face. The conveyance member conveys the recording medium while attracting the recording medium thereon by an electrostatic force. The charger conducts a charging operation of the conveyance member to generate the electrostatic force for attracting the recording medium on the conveyance member. The controller controls, based on a state of the first face having the image formed thereon, the charging operation for generating the electrostatic force in the conveyance member during an image formation on the second face, and controls a pause operation of a conveyance of the recording medium after the image formation on the second face.

Additional features and advantages will be more fully apparent from the following detailed description, the accompanying drawings, and the associated claims.

BRIEF DESCRIPTION OF THE DRAWINGS

A more complete appreciation of the subject matter of this disclosure and many of the attendant advantages thereof will be readily obtained as the same becomes better understood by reference to the following detailed description when considered in connection with the accompanying drawings, wherein.

Figure 1:
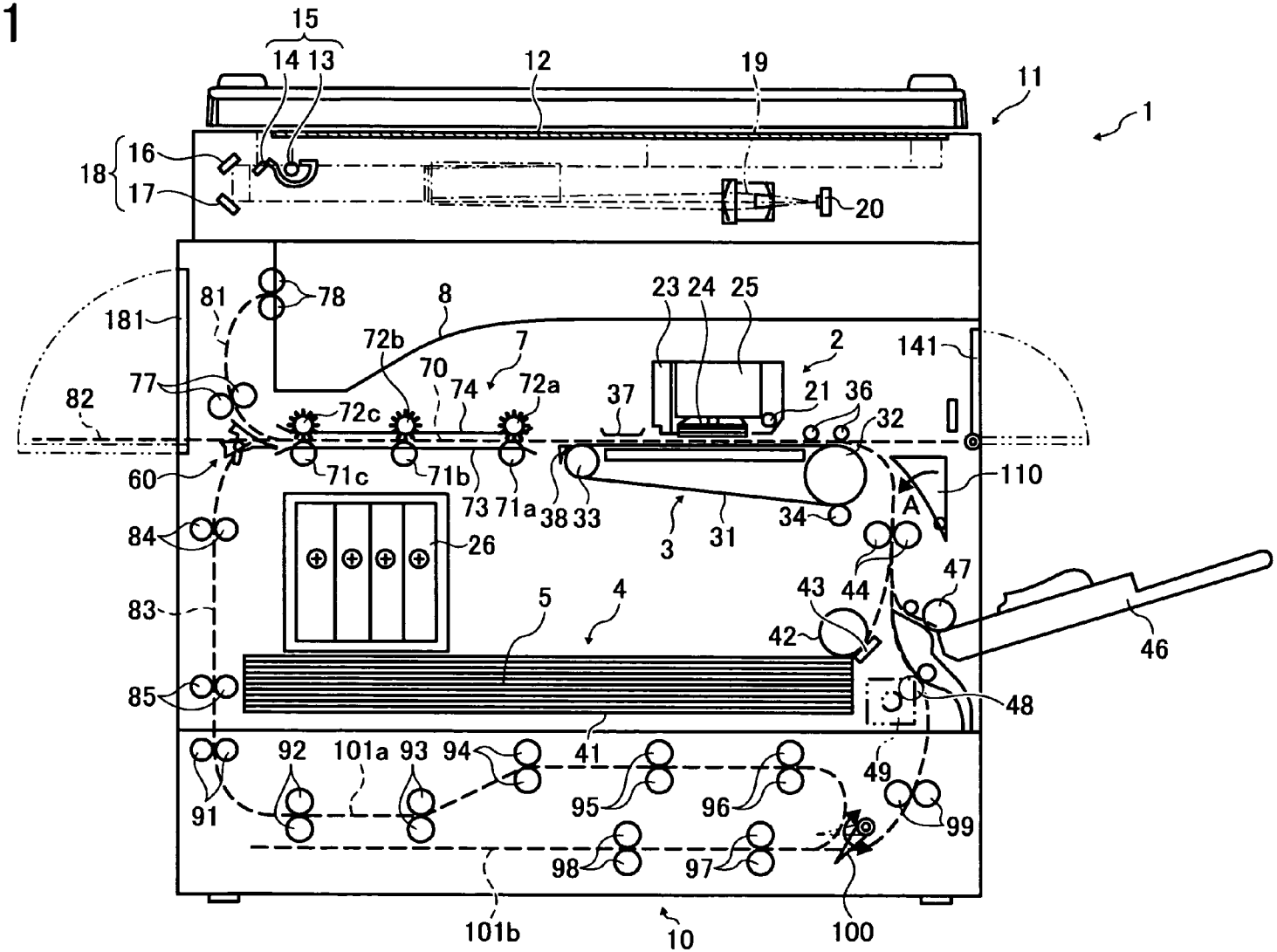
FIG. 1 is a schematic view illustrating an overall structure of an image forming apparatus according to an exemplary embodiment of the disclosure.

The drawings are intended to depict exemplary embodiments of the present disclosure and should not be interpreted to limit the scope thereof. The drawings are not to be considered as drawn to scale unless explicitly noted.

DETAILED DESCRIPTION OF EXEMPLARY EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein to facilitate description of one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc., may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to limit the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are used for materials and constituent parts having the same functions, and descriptions thereof will be omitted unless otherwise stated. Exemplary embodiments of the present disclosure are now explained below with reference to the accompanying drawings. In the later described comparative example, exemplary embodiment, and alternative example, the same reference numerals will be used for constituent elements such as parts and materials having the same functions, and the descriptions thereof will be omitted.

Referring now to the drawings, wherein like reference numerals designate identical or corresponding parts throughout the several views, exemplary embodiments of the present disclosure are described. It should be noted that the present disclosure is not limited to the exemplary embodiments as illustrated in the drawings.

Hereinafter, exemplary embodiments are described with reference to multi-functional image forming apparatuses capable of executing functions of a printer, a copier, a scanner, etc. However, it should be noted that the present disclosure is also applicable to printers, copiers, facsimile machines, or other image forming apparatuses. Further, the present disclosure is applicable to image forming apparatuses employing liquid other than ink.

Figure 2:
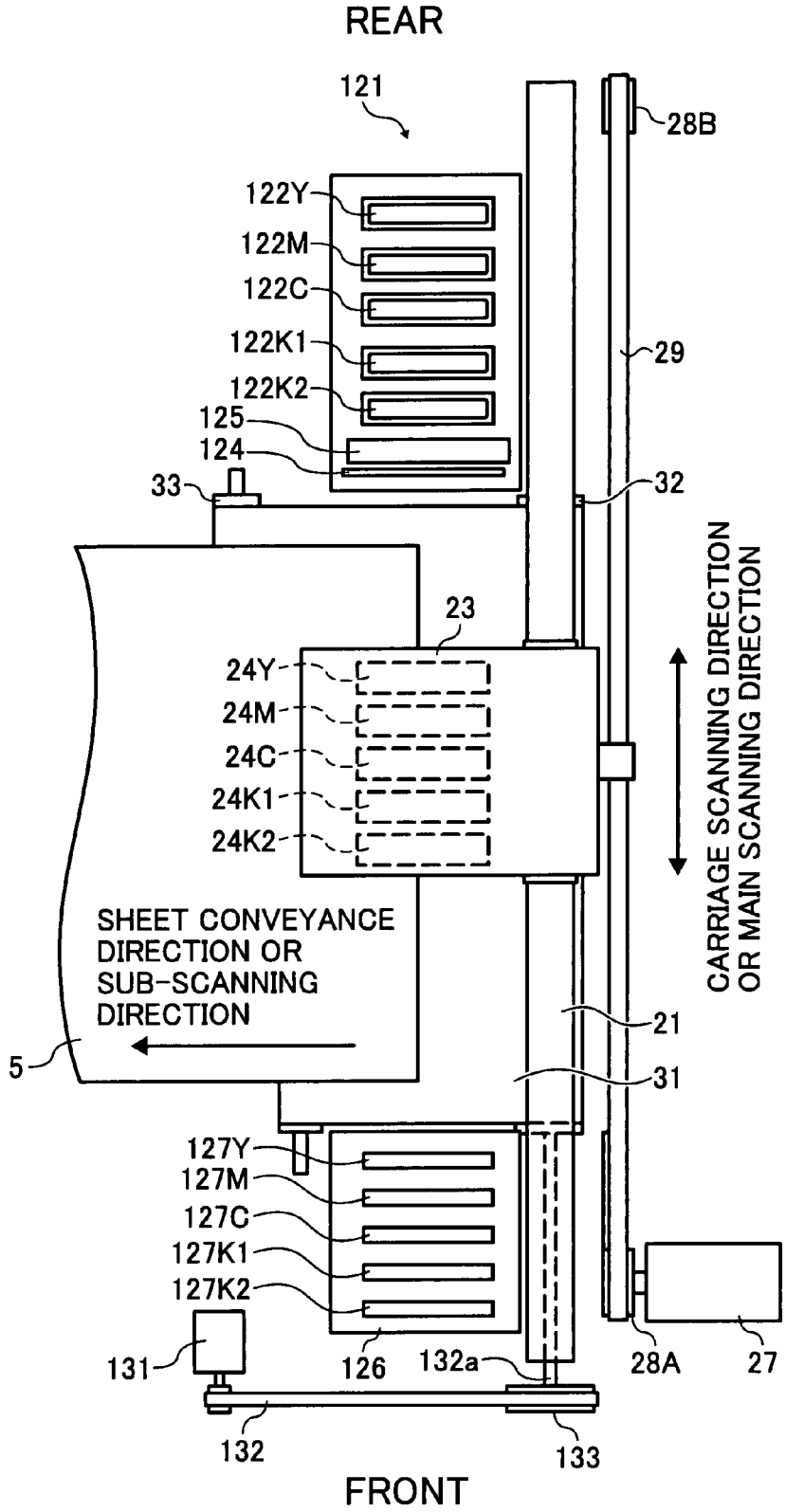
FIG. 2 is a plan view illustrating an image forming unit and a sheet conveyance unit employed in the image forming apparatus of FIG. 1.
Figure 3:
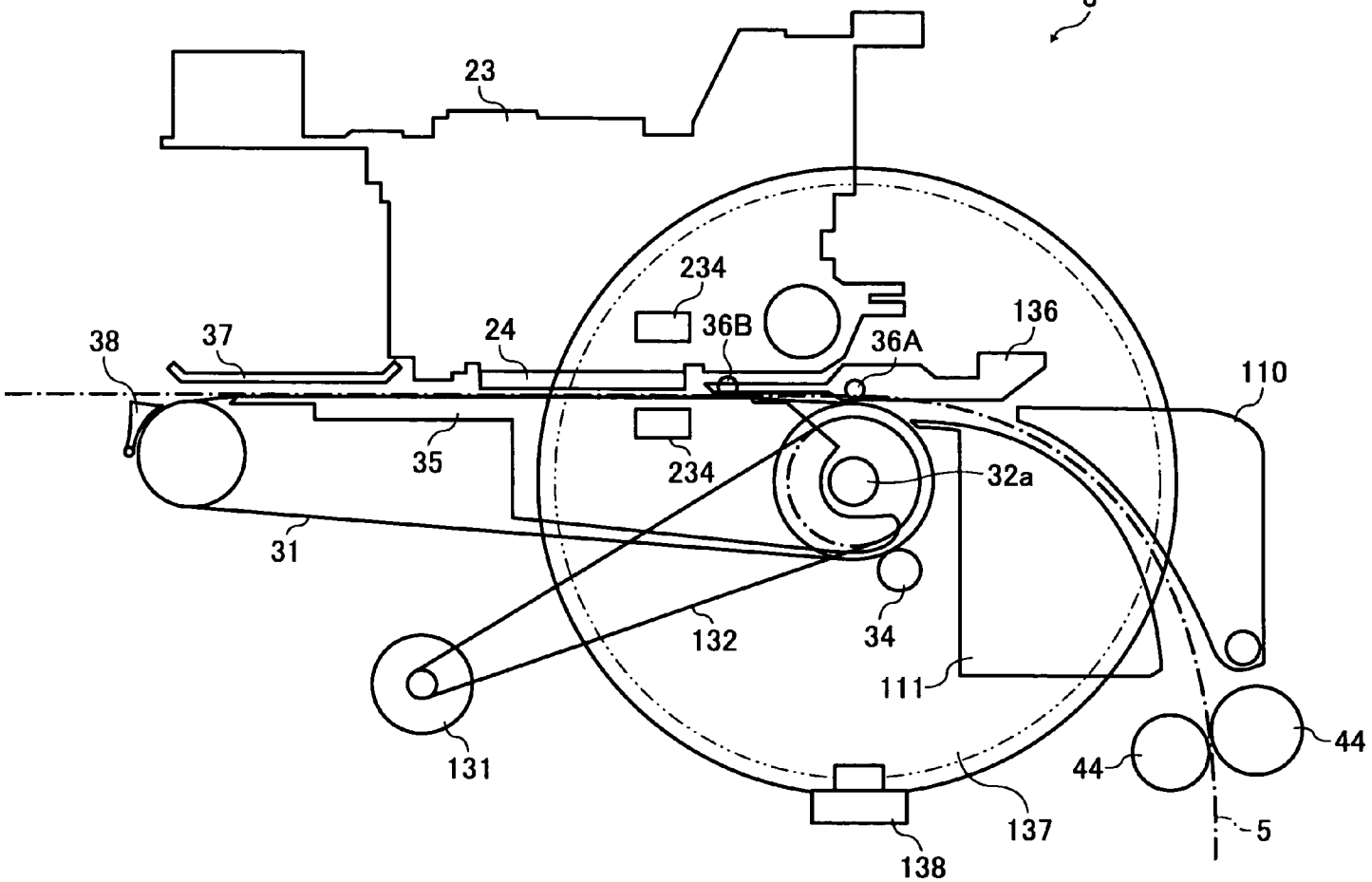
FIG. 3 is a partial side view illustrating an image forming unit and a sheet conveyance unit employed in the image forming apparatus of FIG. 1.
Figure 4:
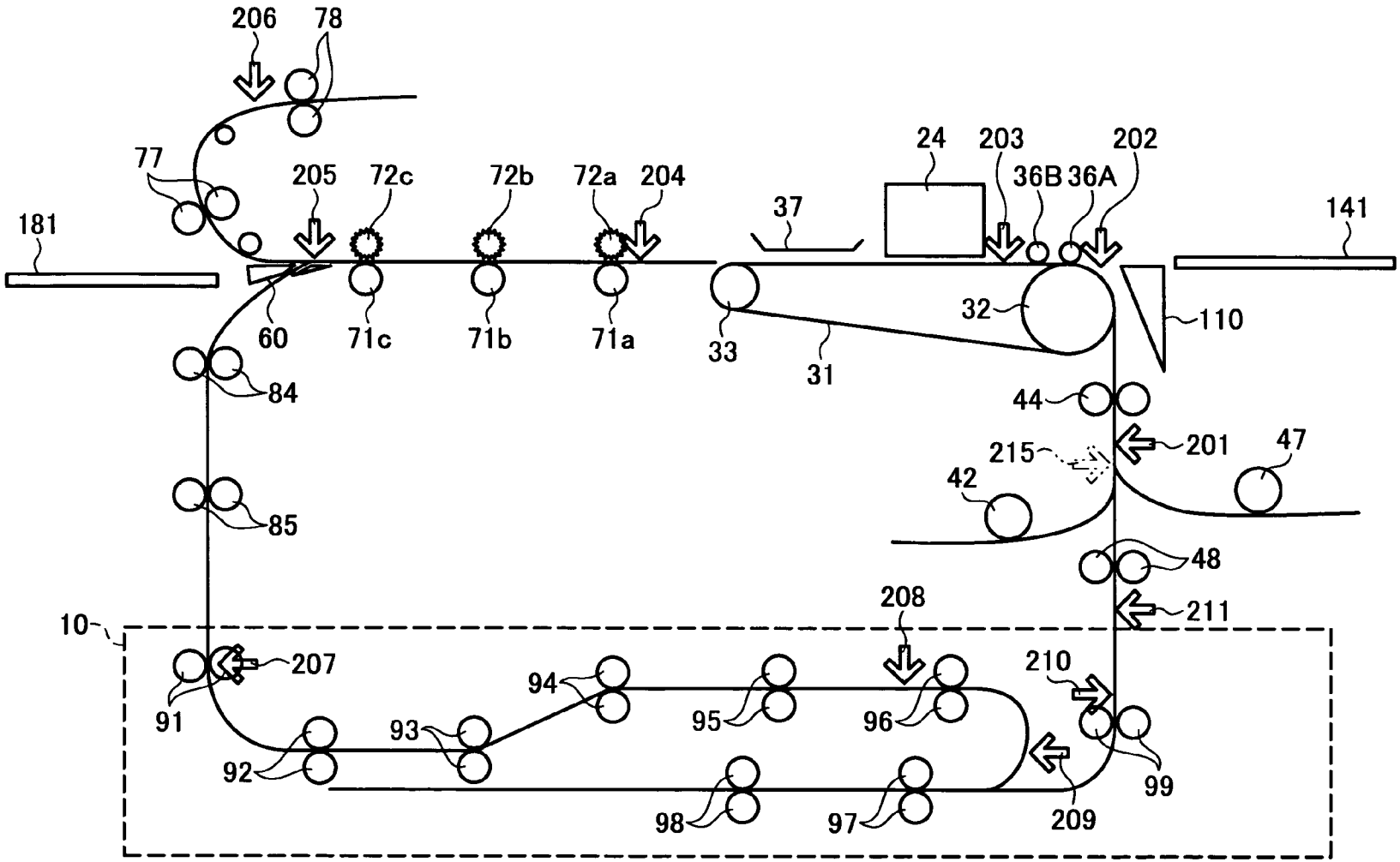
FIG. 4 is a schematic view for explaining sheet conveyance paths used in a duplex print mode of the image forming apparatus of FIG. 1.

First, an image forming apparatus according to an exemplary embodiment is described with reference to FIGS. 1 to 4. FIG. 1 is a schematic view illustrating an overall structure of the image forming apparatus. FIG. 2 is a plan view illustrating an image forming unit and a sheet conveyance unit of the image forming apparatus. FIG. 3 is a partial side view illustrating the image forming unit and the sheet conveyance unit. FIG. 4 is a schematic illustration for explaining sheet conveyance paths used in a duplex print mode.

As illustrated in FIG. 1, the image forming apparatus 1 may include an image forming unit 2, a sheet conveyance unit 3, a sheet feed unit 4, a sheet ejecting unit 7, an ejection tray 8, and a duplex unit 10.

The image forming unit 2 forms an image on a recording medium 5 conveyed by the sheet conveyance unit 3. The recording medium 5 may not be limited to a typical recording paper sheet but may include other media, such as an OHP (over head projector) film, onto which droplets of ink or other liquid are ejected. Hereinafter, various kinds of recording media may be simply referred as a "sheet" for simplicity.

In an image forming operation, the sheet feed unit 4 feeds the sheet 5 one by one from a sheet feed cassette 41 to the sheet conveyance unit 3. The sheet conveyance unit 3 conveys the sheet 5 to a position facing the image forming unit 2. The image forming unit 2 ejects liquid droplets onto a first face of the sheet 5 to form a desired image.

In a simplex print mode or a single-sided print mode, the sheet ejecting unit 7 ejects the sheet 5 having the image on the first face to the ejection tray 8. Alternatively, in a duplex print mode or a two-sided print mode, by switching the conveyance direction of the sheet 5 on the way in the sheet ejecting unit 7, the sheet 5 is conveyed into the duplex unit 10 disposed at the bottom portion of the image forming apparatus 1. The duplex unit 10 conveys the sheet 5 in a switchback manner and re-feeds the sheet 5 to the sheet conveyance unit 3. The image forming unit 2 also forms another image on a second face of the sheet 5. The sheet ejecting unit 7 ejects the sheet 5 having the images on both faces to the ejection tray 8.

The image forming apparatus 1 may also include an image reading unit 11 (e.g., scanner) as an input system of image data used in the image forming unit 2. The image reading unit 11 is disposed above the ejection tray 8 in an upper portion of the image forming apparatus 1. The image reading unit 11 reads an image to generate image data based on the image. The image reading unit 11 may include a contact glass 12, an optical scanning system 15, an optical scanning system 18, a lens 19, and an image reading element 20. The optical scanning system 15 includes a light source 13 and a mirror 14, while the optical scanning system 18 includes mirrors 16 and 17.

The image reading unit 11 moves the optical scanning systems 15 and 18 to scan a target image on a source document, which is placed on the contact glass 12. The scanned image is read as image signals by the image reading element 20, which is disposed at a rear side of the lens 19. The read image signals are digitized and are subjected to image processing. Thus, the image signals become printable as the print data having been subjected to the digitization and image processing.

As illustrated in FIG. 2, the image forming unit 2 of the image forming apparatus 1 movably holds the carriage 23 in a cantileverly manner with a guide rod 21 and a guide rail (not illustrated). A main scanning motor 27 causes the carriage 23 to move in a main scanning direction through a timing belt 29 that is extended between a driving pulley 28A and a driven pulley 28B.

A recording head assembly 24 is attached to the carriage 23. The recording head assembly 24 includes at least one liquid ejecting head for ejecting liquid droplets of each color. For example, as illustrated in FIG. 2, the recording head assembly 24 may include: two liquid ejecting heads 24K1 and 24K2 for ejecting black ink (K); and three liquid ejecting heads 24C, 24M, and 24Y for ejecting ink of cyan (C), magenta (M), and yellow (Y) colors, respectively. Each color of ink is supplied from a corresponding one of sub-tanks 25 mounted on the carriage 23.

In FIG. 2, the recording head assembly 24 forms a so-called shuttle head. In this case, the sheet conveyance unit 3 stepwisely feeds the sheet 5 in the sheet conveyance direction or the sub-scanning direction illustrated in FIG. 2. In synchronous with such stepwise feeding, the recording head assembly 24 ejects liquid droplets onto the sheet 5 while the carriage 23 is traveling in the main scanning direction.

Alternatively, the recording head assembly 24 may form a line head having a width corresponding to a width of a recording medium.

As illustrated in FIG. 1, four ink cartridges 26 for accommodating ink of black, cyan, magenta, and yellow colors, respectively, may be detachably mounted to a cartridge mounting portion from the front side of the image forming apparatus 1. Each of the ink cartridges 26 supplies ink to a corresponding one of the sub-tanks 25. The black ink is supplied from one of the ink cartridges 26 to corresponding two of the sub-tanks 25.

Different types of recording heads, such as piezoelectric, thermal, and electrostatic types, may be used for the recording head assembly 24. For example, a piezoelectric recording head uses a piezoelectric element as a pressure generating mechanism or an actuator mechanism to apply pressure to the ink in an ink channel or a pressure generating chamber. Such pressure deforms a diaphragm forming a wall of the ink channel and thus changing the volume of the ink channel, thereby ejecting ink droplets.

The thermal recording head uses a heating element to heat the ink in the ink channel so as to generate bubbles in the ink. Such bubbles cause pressure to the ink, thereby ejecting ink droplets.

In the electrostatic recording head, the diaphragm that forms the wall of the ink channel is disposed to face an electrode so that an electrostatic force may be generated between the diaphragm and the electrode. Generating such an electrostatic force deforms the diaphragm, thereby changing the volume of the ink channel. Thus, ink droplets are ejected from the electrostatic recording head.

As illustrated in FIG. 2, a nozzle maintenance unit 121 is disposed in a non-print region located on one side of the scanning direction of the carriage 23. The nozzle maintenance unit 121 maintains and recovers nozzles of the recording head assembly 24 to a good condition. The nozzle maintenance unit 121 may include five moisturizing caps 122K2, 122K1, 122C, 122M, and 122Y to cover the nozzle faces of the liquid ejecting heads 24K2, 24K1, 24C, 24M, and 24Y, respectively.

The nozzle maintenance unit 121 may further include a suction cap (not illustrated), a wiping blade 124, and a waste droplet receiving member 125. The wiping blade 124 wipes the nozzle face of the recording head assembly 24. The waste droplet receiving member 125 receives droplets ejected in a so-called "dummy ejection" operation, which is conducted for the purpose of maintaining and/or recovering the nozzle to a good condition.

Further, as illustrated in FIG. 2, a waste droplet receiving unit 126 is provided in a non-print region on the other side in the scanning direction of the carriage 23. The waste droplet receiving unit 126 also receives waste droplets that are ejected in a "dummy-ejection" operation as described above. The waste droplet receiving unit 126 may further include openings 127K2, 127K1, 127C, 127M, and 127Y corresponding to the liquid ejection heads 24K2, 24K1, 24C, 24M, and 24Y, respectively.

As illustrated in FIG. 3, the sheet conveyance unit 3 may include an conveyance belt 31, a conveyance roller 32, a driven roller 33, a charging roller 34, a platen guide member 35, a pressing roller 36A, a front-edge pressing roller 36B, a guide plate 37, a separation claw 38 and a holding member 136.

As illustrated in FIG. 3, the conveyance belt 31 may have an endless shape and be extended between the conveyance roller 32, serving as a driving roller, and the driven roller 33, serving as a tension roller. The conveyance belt 31 turns the conveyance direction of the sheet 5, which is fed from the lower portion, by approximately 90 degrees. Thus, the conveyance belt 31 conveys the sheet 5 so that the sheet 5 may face the image forming unit 2.

The charging roller 34 is applied with a high alternating voltage by a high-voltage power source and then charges the surface of the conveyance belt 31. The platen guide 35 guides the conveyance belt 31 in an area opposite to the image forming unit 2. The pressing roller 36A, rotatably held with the holding member 136, presses the sheet 5 against the conveyance belt 31 at a portion opposite to the conveyance roller 32. The front-edge pressing roller 36B presses the sheet 5 against the conveyance belt 31 on an upstream side of the recording head assembly 24 in the sheet conveyance direction. The guide plate 37 holds the front face of the sheet 5 having the image formed by the image forming unit 2. The separating claw 38 separates the sheet 5, having the image thereon, from the conveyance belt 31.

As illustrated in FIG. 3, the sheet conveyance unit 3 may further include a sub-scanning motor 131, a timing belt 132, a timing roller 133, an encoder wheel 137, and an encoder sensor 138. The sub-scanning motor 131 uses a DC brushless motor to rotate the conveyance roller 32 through the timing belt 132 and the timing roller 133. Thereby, the conveyance belt 31 of the sheet conveyance unit 3 is rotated in the sheet conveyance direction or the sub-scanning direction indicated by the arrow illustrated in FIG. 2.

The conveyance belt 31 may have a double layer structure, for example. In such a case, the conveyance belt 31 includes a first layer and a second layer. The first layer may serve as a sheet attracting face and may be made of pure resin material such as ETFE (Ethylene TetrafluoroEthylene) pure material, which is not subjected to resistance control. The second layer (a mid-resistance layer or a ground layer) may be made of the identical material as that of the first face but may be subjected to resistance control by carbon. Alternatively, the conveyance belt 31 may have a single layer structure or a three or more layer structure.

Furthermore, the sheet conveyance unit 3 may be provided with a cleaner and a discharging brush (not illustrated) between the driven roller 33 and the charging roller 34. The cleaner removes paper or other dust remaining on the surface of the conveyance belt 31. The discharging brush discharges the electric charges on the surface of the conveyance belt 31.

In FIG. 3, the encoder wheel 137 having a relatively high resolution is mounted to a shaft 32*a* of the conveyance roller 32. The encoder sensor 138 includes a transmission photo sensor that detects slits provided in the encoder wheel 137. The encoder wheel 137 and the encoder sensor 138 form a rotary encoder 402, later described.

As illustrated in FIG. 1, the sheet feed unit 4 may include a sheet feed cassette 41, a sheet feeding roller 42, a friction pad 43, and a pair of registration rollers 44. The sheet feed unit 4 is removably inserted to the image forming apparatus 1 from the front side, and is capable of carrying a number of sheets 5. The sheet feeding roller 42 and the friction pad 43 separate the sheets 5 one by one from the sheet feed cassette 41 and feeds the sheet 5 to the pair of registration rollers 44. The pair of registration rollers 44 registers the sheet 5 thus fed.

As illustrated in FIG. 1, the sheet feed unit 4 may further include a manual feed tray 46, a manual feeding roller 47, a pair of conveyance rollers 48, and a sheet feeding motor 49. The manual feed tray 46 is capable of carrying a number of sheets 5. The manual feed roller 47 feeds the sheet 5 one by one from the manual feed tray 46. The pair of conveyance rollers 48 conveys, in a substantially vertically upward direction, a sheet 5 that is fed from an optional sheet feed cassette provided at the bottom portion of the image forming apparatus 1 or from the duplex unit 10, described later in detail. The sheet feeding motor 49, serving as a driving mechanism, may be formed of a hybrid (HB) stepping motor. The sheet feeding motor 49 rotationally drives, via the electromagnetic clutch, the above-described members, such as the sheet feeding roller 42, the pair of registration rollers 44, the manual feed roller 47, and the pair of conveyance rollers 48. Thus, the sheet 5 is fed to the sheet conveyance unit 3.

As illustrated in FIG. 1, the sheet ejecting unit 7 may include three conveyance rollers 71*a*, 71*b*, and 71*c*, three spurs 72*a*, 72*b*, and 72*c* facing the conveyance rollers 71*a*, 71*b*, and 72*c*, respectively, a lower guide member 73 and an upper guide member 74, a pair of sheet reversing rollers 77, and a pair of reverse sheet ejecting rollers 78. Unless otherwise specified, "the conveyance rollers 71*a*, 71*b*, and 71*c* are hereinafter collectively referred to as the conveyance rollers 71." Similarly, the spurs 72*a*, 72*b*, and 72*c* are hereinafter collectively referred to as "the spurs 72".

The conveyance rollers 71 convey the sheet 5 separated by the separation claw 38 of the sheet conveyance unit 3. The lower guide member 73 and the upper guide member 74 guide the sheet 5 in a space between the conveyance rollers 71 and the spurs 72. The pair of sheet reversing rollers 77 conveys the sheet 5 in a reverse manner along a first sheet-ejection path or a sheet reverse-ejection path 81. The pair of sheet reverse-ejecting rollers 78 ejects the sheet 5 in a face-down manner to the ejection tray 8. A conveyance path 70 is formed between the lower guide member 73 and the upper guide member 74.

As illustrated in FIG. 1, at an exit side of the conveyance path 70 is provided a switching mechanism 60 for switching the sheet conveyance path between the first sheet-ejection path 81, a second sheet-ejection path 82, and a third sheet-conveyance path 83.

The first sheet-ejection path 81 is used to eject the sheet 5 in a face-down manner to the ejection tray 8 as described above. The second sheet-ejection path 82 is used to eject the sheet 5 to a linear ejection tray 181, described later. The third sheet-ejection path 83 is used to convey the sheet 5 into the duplex unit 10. Along the third sheet-conveyance path 83 are provided two pairs of relaying rollers 84 and 85 for feeding the sheet 5, having an image on the first face, to the duplex unit 10.

As illustrated in FIG. 1, the duplex unit 10 may include a standby path 101*a*, a switchback conveyance path 101*b*, six pairs of conveyance rollers 91 to 96, two pairs of reversing rollers 97 and 98, a pair of duplex-unit exit rollers 99, and a switching plate 100. The six pairs of conveyance rollers 91 to 96 are disposed in turn along the standby path 101*a* from the entrance side. The two pairs of reversing rollers 97 and 98 are disposed along the switchback conveyance path 101*b*. The pair of duplex-unit exit rollers 99 feeds the sheet 5 to the pair of conveyance rollers 48 to form an image on the second face of the sheet 5.

As illustrated in FIG. 1, the switching plate 100 may be provided so as to be pivotable between a switchback position, indicated by a solid line, and a re-feed position, indicated by a broken line. The switching plate 100 switches the conveyance path of the sheet 5 between a conveyance path, from the standby path 101*a* to the switchback conveyance path 101*b*, and a re-feed path, from the switchback conveyance mechanism 101*b* to the pair of conveyance rollers 48.

The sheet 5 re-fed from the duplex unit 10 is conveyed to the pair of conveyance rollers 48 and then to the pair of registration rollers 44.

As illustrated in FIGS. 1 and 3, a guide panel 110 is pivotably provided above the pair of registration rollers 44. When the pair of registration rollers 44 conveys the sheet 5 fed from one of the sheet feeding cassette 41, the manual feed tray 46, and the duplex unit 10, the guide panel 110 bends the sheet 5 in an arc shape along the conveyance path from the pair of registration rollers 44 to the conveyance roller 32 and the pressing roller 36. Thus, the guide panel 110 causes the sheet 5 to have looseness, thereby suppressing back tension against the sheet 5.

When the sheet 5 is conveyed from the pair of registration rollers 44 to the sheet conveyance unit 3, the guide panel 110 is pivoted from a home position as illustrated in FIG. 1 in the direction indicated by an arrow "A" so as to guide the sheet 5. When the sheet 5 reaches the sheet conveyance unit 3, the guide panel 110 returns to the home position to be capable of bending the sheet 5 in an arc shape.

Moreover, as illustrated in FIG. 1, the image forming apparatus 1 may be provided with a single-sheet manual feed tray 141 used for a user to manually feed a single sheet. The single-sheet manual feed tray 141 may be openably and closably provided at one side of the image forming apparatus 1. The single-sheet manual feed tray 141 may be configured to be tilted open as illustrated in FIG. 1. Alternatively, the single-sheet manual feed tray 141 may be configured to be pulled open relative to the image forming apparatus 1.

When a single sheet is manually fed, the single-sheet manual feed tray 141 is tilted open to the position indicated by a dash double-dotted line in FIG. 1. The sheet 5 manually fed from the single-sheet manual feed tray 141 is guided along the upper surface of the guide panel 110 so as to be linearly inserted between the conveyance roller 32 and the pressing roller 36A of the sheet conveyance unit 3.

Further, the image forming apparatus 1 may be provided with a linear ejection tray 181 to linearly eject the sheet 5, having been subjected to image formation, in a face-up manner. The linear ejection tray 181 may also be openably and closably provided at the other side of the image forming apparatus 1 relative to the single-sheet manual feed tray 141. The linear ejection tray 181 may be configured to be tilted open as illustrated in FIG. 1. Alternatively, the linear ejection tray 181 may be configured to be pulled open relative to the image forming apparatus 1.

When the sheet 5 is fed from the space between the lower guide member 73 and the upper guide member 74 to the linear ejection tray 181, the linear ejection tray 181 is tilted open. Thus, the second sheet-ejection path 82 is formed to linearly eject the sheet 5 to the linear ejection tray 181.

For example, when the sheet 5 is a recording medium of a type that has some difficulty in being curvilinearly conveyed, such as an OHP film or a thick paper sheet, the sheet 5 may be manually fed from the single-sheet manual feed tray 141 so as to be linearly conveyed and ejected to the linear ejection tray 181. When the sheet 5 is a normal sheet such as a plain paper sheet, the sheet 5 may also be fed from the single-sheet manual feed tray 141 so as to be linearly conveyed and ejected to the linear ejection tray 181.

Next, locations of various sensors are described with reference to FIG. 4. As illustrated in FIG. 4, the image forming apparatus 1 may include a conveyance registration sensor 201, an image-forming-unit entry sensor 202, an image registration sensor 203, an image-forming-unit exit sensor 204, a switching sensor 205, a sheet ejecting sensor 206, a duplex-unit entry sensor 207, a standby sensor 208, a sheet reverse sensor 209, a duplex-unit exit sensor 210, an electromagnetic-clutch open sensor 211.

The conveyance registration sensor 201 may be disposed on an upstream side of the pair of registration rollers 44 in the sheet conveyance direction. The image-forming-unit entry sensor 202 may be disposed on an upstream side of the conveyance roller 32 and the pressing roller 36A. The image registration sensor 203 for registering a start position of image writing may be disposed on a downstream side of the front-edge pressing roller 36B or at an entrance to the image forming unit 2.

Further, the image-forming-unit exit sensor 204 may be disposed at an exit from the image forming unit 2 or on an upstream portion of the conveyance roller 71*a* and the spur 72*a*. The switching sensor 205 may be disposed on an exit side of the sheet ejecting unit 7. The sheet ejecting sensor 206 may be disposed on an upstream side of the pair of sheet ejecting rollers 78.

Furthermore, the duplex-unit entry sensor 207 may be disposed on the pair of conveyance rollers 91 of the duplex unit 10. The standby sensor 208 may be disposed on an upstream side of the pair of conveyance rollers 96. The sheet reverse sensor 209 may be disposed at the switching plate 100. The duplex-unit exit sensor 210 may be disposed on a downstream side of the pair of duplex-unit exit rollers 99. The electromagnetic-clutch open sensor 211 may be disposed on an upstream side of the pair of conveyance rollers 48.

Next, a control unit of the image forming apparatus is described with reference to FIG. 5.

Figure 5:
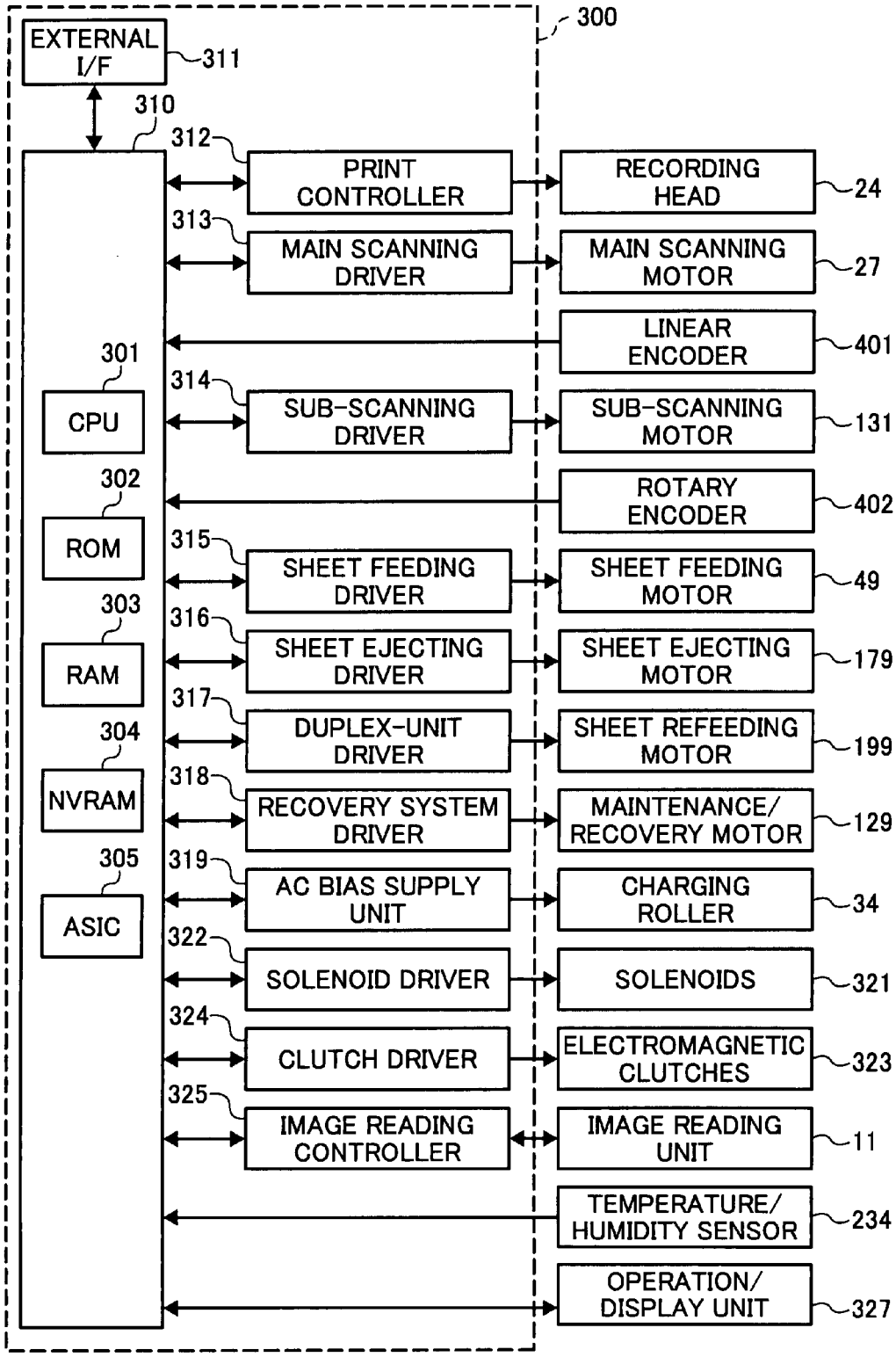
FIG. 5 is a block diagram illustrating a control unit employed in the image forming apparatus of FIG. 1.

FIG. 5 is a block diagram illustrating a control unit 300 of the image forming apparatus 1. The control unit 300 includes a main controller 310 that generally controls over the image forming apparatus 1. As illustrated in FIG. 5, the control unit 300 may include a central processing unit (CPU) 301, a read-only memory (ROM) 302, a random access memory (RAM) 303, a non-volatile random access memory (NVRAM) 304, an application specific integrated circuit (ASIC) 305.

The ROM 302 stores programs, executed by the CPU 301, and other fixed data. The RAM 303 temporarily stores data such as image data. The NVRAM 304 maintains data even while the power of the image forming apparatus 1 is in an off-state. The ASIC 305 executes various processing, such as various signal processing on image data, image processing for sorting images, and input/output signal processing for controlling the image forming apparatus 1.

As illustrated in FIG. 5, the control unit 300 may further include an external interface (I/F) 311, a print controller 312, a main scanning driver or motor driver 313, a sub-scanning driver 314, a sheet feeding driver 315, a sheet ejecting driver 316, a duplex-unit driver 317, a recovery system driver 318, an alternating current (AC) bias supply unit 319, a solenoid driver 322, a clutch driver 324, and an image reading controller 325.

The external I/F 311 transmits and receives data and signals while mediating between an external host and the main controller 310. The print controller 312 includes a head driver for controlling driving of the recording head assembly 24. The main scanning controller 313 drives the main scanning motor 27 that causes the carriage 23 to move and scan. The sub-scanning driver 314 drives the sub-scanning motor 131. The sheet feeding driver 315 drives the sheet feeding motor 49. The sheet ejecting driver 316 drives a sheet ejecting motor 179 that drives the rollers of the sheet ejecting unit 7. The duplex-unit driver 317 drives a sheet refeeding motor 199 that drives the rollers of the duplex unit 10. The recovery system driver 318 drives a maintenance/recovery motor 129 that drives the nozzle maintenance unit 121. The AC bias supply unit 319 supplies an AC bias to the charging roller 34.

The solenoid driver 322 drives various types of solenoids 321. The clutch driver 324 drives electromagnetic clutches 323 relating to the sheet feeding operation. The image reading controller 325 controls the image reading unit 11.

The main controller 310 receives detection signals from temperature/humidity sensors 234 that detects ambient temperature and humidity of the conveyance belt 31. The main controller 310 also receives detection signals from other sensors as illustrated in FIG. 4. The main controller 310 communicates with an operation/display unit 327 to receive key input data and output display data. The operation/display unit 327 includes various keys, such as numeric keys and a print start key, and various display devices, which are provided to the image forming apparatus 1.

Further, the main controller 310 receives an output signal or a detection pulse from a linear encoder 401. The linear encoder 401 includes an encoder scale and a photo sensor (or an encoder sensor). The encoder scale is arranged along the main scanning direction to determine a travel distance of the carriage 23. The photo sensor detects slits of the encoder scale. Based on the output signal of the linear encoder 401, the main controller 310 controls driving of the main scanning motor 27 via the main scanning driver 313 so that the carriage 23 travels a given distance in a given direction.

Furthermore, the main controller 310 receives an output signal or a detection pulse from the rotary encoder 402. As described above, the rotary encoder 402 includes the encoder wheel 137 and the encoder sensor 138. Based on the output signal from the rotary encoder 402, the main controller 310 controls driving of the sub-scanning motor 131 via the sub-scanning driver 314. Thus, the main controller 310 causes the sub-scanning driver 314 to move the conveyance belt 31 via the conveyance roller 32.

Next, a charging control process of the conveyance belt 31 of the image forming apparatus 1 is described with reference to FIGS. 6 to 8.

Figure 6:
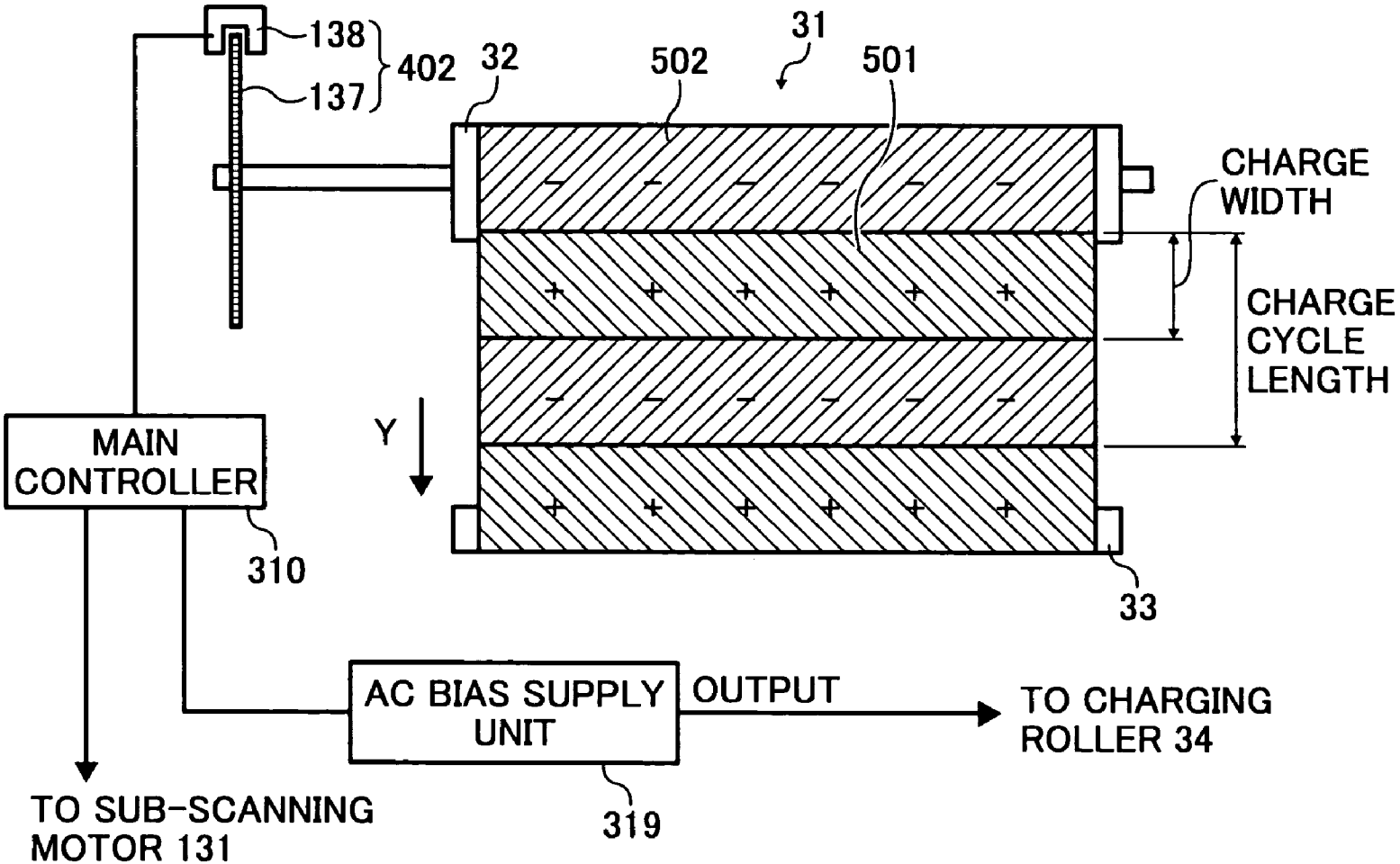
FIG. 6 is a schematic illustration for explaining a charge control to a conveyance belt employed in the image forming apparatus of FIG. 1.
Figure 7:
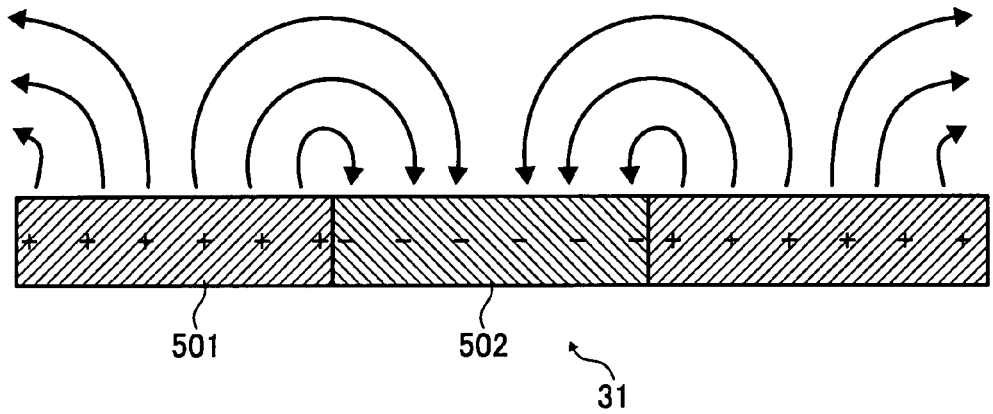
FIG. 7 is a schematic illustration for explaining an electric field generated when the conveyance belt is charged.

FIG. 6 schematically illustrates relevant portions of the charging control of the conveyance belt 31. As illustrated in FIG. 6, the rotary encoder 402 including the encoder wheel 137 and the encoder sensor 138 is provided at one end portion of the conveyance roller 32 that drives the conveyance belt 31. The rotary encoder 402 determines the rotation speed of the conveyance belt 31. Based on the determined rotation speed, the main controller 310 controls driving of the sub-scanning motor 131 via the sub-scanning driver 314.

In the meantime, the main controller 310 controls output of the AC bias supply unit 319 so that a high voltage or AC bias may be applied to the charging roller 34.

The AC bias supply unit 319 controls a cycle or duration of application voltage of positive and negative polarities to be applied to the charging roller 34. In the meantime, the main controller 310 controls driving of the conveyance belt 31. Thus, positive and negative electric charges may be applied on the conveyance belt 31 at a given charge cycle length.

As illustrated in FIG. 6, the charge cycle length refers to a width or distance of one set of a positively-charged area 501 and a negatively-charged area 502 in the belt travel direction indicated by an arrow Y in FIG. 6. Further, a charge width refers to a width or distance of each area of the positively-charged area 501 and a negatively-charged area 502 in the belt travel direction.

When printing is initiated, the sub-scanning motor 131 rotationally drives the conveyance roller 32 so that the conveyance belt 31 rotates in the counterclockwise direction in FIG. 1.

In the meantime, the AC bias supply unit 319 applies positive and negative square waves to the charging roller 34. Because the charging roller 34 is in contact with a front face or an insulation layer of the conveyance belt 31, as illustrated in FIG. 6, positive and negative charges are alternately applied to the insulation layer of the conveyance belt 31 in the belt travel direction Y of the conveyance belt 31. Thus, the positively-charged area 501 and the negatively-charged area 502, having a band shape, are alternately formed on the conveyance belt 31. As a result, a non-uniform electric field is formed on the conveyance belt 31 as illustrated in FIG. 7.

The insulation layer of the conveyance belt 31, on which positive and negative charges are applied, may be formed so as to have a volume resistance of, for example, $10^{12}$ Ωcm or more, and desirably $10^{15}$ Ωcm. Therefore, the positive and negative charges on the insulation layer may be prevented from moving across the boundary between the respective regions. Thus, the positive and negative charges applied to the insulation layer may be maintained in the respective regions.

When a sheet 5 is conveyed onto the conveyance belt 31 having the non-uniform electric field thereon, the sheet 5 is immediately electrically polarized along a direction of the electric field.

Figure 8:
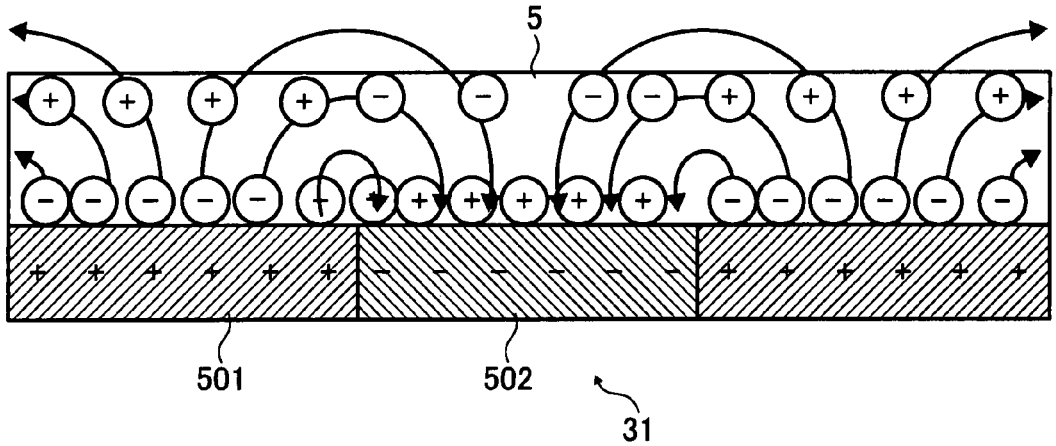
FIG. 8 is an illustration for explaining movement of electric charges when the conveyance belt is brought into contact with a sheet.

As illustrated in FIG. 8, because of the non-uniform electric field, electric charges become dense on the back face of the sheet 5 facing the conveyance belt 31 and result in a corresponding attraction force for the conveyance belt 31. On the other hand, electric charges become sparse on the front face of the sheet 5 and serve as a repulsive force against the conveyance belt 31.

Due to such difference in the amount of electric charges, the sheet 5 is immediately attracted to the conveyance belt 31. At this time, because the sheet 5 has a finite resistance, true electric charges are induced on the suction face or back face of the sheet 5, which is attracted to the conveyance belt 31, and on the front face thereof, which is opposite to the suction face.

The true electric charges of positive and negative polarities, which are induced on the back face of the sheet 5, attract the electric charges of complementary polarities being applied on the conveyance belt 31, thereby serving as a stable attractive force for the conveyance belt 31.

On the other hand, the true electric charges induced on the front face of the sheet 5 relatively easily move around because the sheet 5 has a finite resistance value in a range from $10^7$ Ω/sq. to $10^{13}$ Ω/sq. Therefore, the neighboring positive and negative electric charges attract each other to be neutralized. Thus, the positive and negative electric charges on the front face of the sheet 5 decrease over time.

As a result, the electric charges applied on the conveyance belt 31 are balanced with the true electric charges induced on the back face of the sheet 5 and thus the electric field is closed. The true electric charges induced on the front face of the sheet 5 are also neutralized as described above and thus the electric field is closed. Thus, the true electric charges, which serve as the repulsive force against the electric charges on the conveyance belt 31, decrease on the front face of the sheet 5. As a result, the attraction force of the sheet 5 for the conveyance belt 31 increases over time.

The above-described attraction force may correlate with temperature, humidity, and/or charge cycle length.

For example, in a high-humidity environment, the resistance value of a sheet generally becomes low. Therefore, depending on the resistance value, the attraction force of the sheet may reach a peak in one second or less, or in the order of milliseconds. Further, the longer the charge cycle length, the attraction force becomes higher.

On the other hand, in a low-humidity environment, the resistance of the sheet generally becomes high. Therefore, the attraction force of the sheet may reach a peak in a relatively long time, or in the order of seconds. In order to reduce the time for the attraction force to reach the peak in a low-humidity environment, the charge cycle length may need to be set relatively shorter. However, if the charge cycle length is shortened, the attraction force may be reduced.

Hence, in the image forming apparatus 1, while the sheet 5 is intermittently conveyed with the conveyance belt 31, the recording head assembly 24 ejects droplets of a recording liquid or ink onto the sheet 5 in accordance with print data so as to form an image. The front edge of the sheet 5, having the image thereon, is separated from the conveyance belt 31 using the separation claw 38. The sheet 5 is ejected to one of the ejection tray 8 and the linear ejection tray 181, as necessary, through the sheet ejecting unit 7. Alternatively, the sheet 5 may be conveyed to the duplex unit 10 so that another image is formed on the other face.

Figure 9:
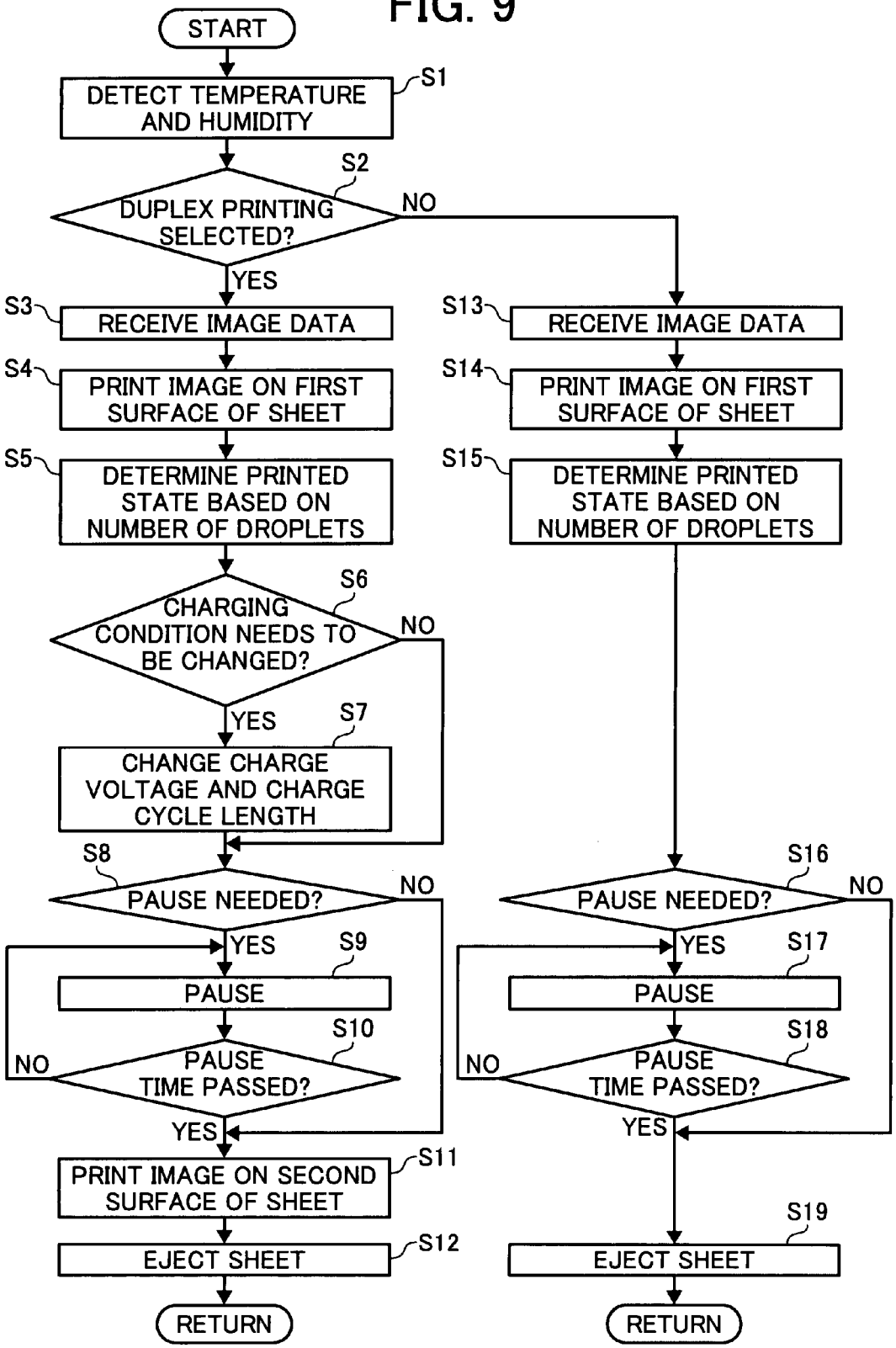
FIG. 9 is a flow chart illustrating a control operation executed by a main controller employed in the image forming apparatus of FIG. 1.

Next, a control operation of the control unit is described with reference to FIG. 9. FIG. 9 is a flow chart illustrating a control operation executed by the main controller 310.

When printing is initiated, at step S1, the main controller 310 determines ambient temperature and humidity in the image forming apparatus 1 based on detection signals of a temperature/humidity sensor, which is disposed near the sheet feed cassette 41. The determined ambient temperature and humidity are used as parameters in the charging control.

At step S2, the main controller 310 determines whether or not a duplex printing mode is selected.

When the duplex printing mode is not selected ("No" at step S2), the processing goes to step S13.

At step S13, the main controller 310 receives image data from an external host.

At step S14, the main controller 310 executes processing to print an image on a first face of a sheet 5.

At step S15, the main controller 310 reads a count value of a droplet counter for counting the number of droplets ejected from the recording head assembly 24 in the printing of the first face. Based on the count value, the main controller 310 estimates the amount of droplets attached on the first face of the sheet 5 and thus determines a printed state of the first face.

At step S16, based on the printed state, the main controller 310 determines whether or not a pause control for pausing the conveyance of the sheet 5 is needed.

If the pause control is needed ("YES" at step S16), after the printing of the first face is finished, at step S17, the main controller 310 executes pause control to pause the conveyance of the sheet 5 in the sheet ejecting unit 7 and keep the sheet 5 in a standby state.

If a given pause time has passed ("YES" at step S18), at step S19, the main controller 310 executes processing to eject the sheet 5 through the first sheet-ejection path 81 to the ejection tray 8.

In this regard, the main controller 310 reads a corresponding pause time from a previously-prepared table in accordance with data such as the ambient temperature and humidity and the amount of droplets. The main controller 310 instructs a pause to the conveyance of the sheet 5 until the pause time passes. At this time, the sheet 5 is stopped at a given position when the rear end of the sheet 5 passes under the recording head assembly 24 or the carriage 23.

Alternatively, when the duplex printing mode is selected ("YES" at step S2), the processing goes to step S3. At step S3, the image controller 310 receives image data from an external host.

At step S4, the main controller 310 executes processing to print an image on a first face of a sheet 5.

At step S5, the main controller 310 reads a count value of a droplet counter for counting the number of droplets ejected from the recording head assembly 24 in the printing of the first face. Based on the count value, the main controller 310 estimates the amount of droplets attached on the first face of the sheet 5 and thus determines a printed state of the first face.

At step S6, based on the printed state, the main controller 310 determines whether or not the condition of the charging control to be executed when a charging roller 34 charges a conveyance belt 31 needs to be changed in the printing of a second face of the sheet 5.

When the main controller 310 determines that the condition of the charging control needs to be changed ("YES" at step S6), at step S7, the main controller 310 changes the AC bias voltage to be supplied from the AC bias supply unit 319 to the charging roller 34. Thus, the main controller 31 changes the charge potential and/or the charge cycle length of the charging roller 34 in the charging of the conveyance belt 31.

At step S8, based on the amount of droplets attached on the first face (for example, whether such amount exceeds a threshold value), the main controller 310 determines whether or not pause control for pausing the conveyance of the sheet 5 is needed.

If the pause control is needed ("YES" at step S8), at step S9, the main controller 310 executes processing to pause the conveyance of the sheet 5 in the sheet ejecting unit 7 and keep the sheet 5 in a standby state.

After a given pause time has passed ("YES" at step S10), at step S11, the main controller 310 conveys the sheet 5 through the third sheet-conveyance path 83 to the duplex unit 10, re-feeds the sheet 5 in a reverse manner, and print an image on a second face of the sheet 5.

When the printing of the second face is finished, at step S12, the main controller 310 executes processing to eject the sheet 5 through the first sheet-ejection path 81 to the ejection tray 8.

Alternatively, when the main controller 310 determines that pause control is not needed ("NO" at step S8), the processing goes to step S11 without executing the pause control.

At step S11, the main controller 310 conveys the sheet 5 through the third sheet-conveyance path 83 to the duplex unit 10.

At step S12, when the printing of the second face is finished, the main controller 310 executes processing to eject the sheet 5 through the first sheet-ejection path 81 to the ejection tray 8.

With regard to pause time, the main controller 310 reads a corresponding pause time from a previously-prepared table in accordance with data such as the ambient temperature and humidity and the amount of droplets.

The main controller 310 instructs a pause to the conveyance of the sheet 5 until a given pause time passes. At this time, the sheet 5 is stopped at a given position when the rear end of the sheet 5 passes under the recording head assembly 24 or the carriage 23. Alternatively, the sheet 5 may be stopped in the duplex unit 10.

The larger the amount of droplets attached on the first face, the less the resistance value of the sheet 5 becomes, compared with a value obtained when no droplets are attached thereon. Therefore, for the printing of the second face, the charge cycle length or the charge potential for the charging roller 34 to charge the conveyance belt 31 may be set longer or larger so as to increase the attraction force of the conveyance belt 31.

In particular, in a low-humidity environment, the resistance value of the sheet 5 becomes relatively high when the printing is carried out on the first face having no droplets attached. Therefore, a greater amount of electric charges may be generated on the sheet 5, causing a greater amount of liquid mist to attach to the sheet 5. Such attachment of liquid mist may need to be suppressed by, for example, shortening the charge cycle length so as to reduce the time it takes for the electric charges on the sheet 5 to be neutralized.

On the other hand, when the printing of the second face is initiated, the resistance value of the sheet 5 may be reduced by the attachment of droplets on the first face. In such a case, even if the charge cycle length is increased, the amount of liquid mist to be attached on the sheet 5 may not be increased. Therefore, a greater attraction force of the conveyance belt 31 may be obtained by increasing the charge cycle length.

In other words, when the printing of the first face is finished, the resistance value of the sheet 5 may be reduced. In such a case, the electric field of the conveyance belt 31 may not affect the recording head assembly 24, thereby suppressing the attachment of liquid mist to the recording head assembly 24. Further, the charge cycle length of the charging roller 34 may be set longer so that the attraction force of the conveyance belt 31 may become higher than the attraction force obtained in the printing of the first face. As a result, the conveyance performance of the conveyance belt 31 may be enhanced.

For example, assume that charge voltage, charge cycle length, and pause time are set to be ±1.4 kV, 8 mm, and 5 seconds, respectively, for charging control and pause control in a normal printing operation. In this case, if the sheet 5 has a solid image on the first face, the charge voltage, the charge cycle length, and the pause time may be changed to ±2.0 kV, 16 mm, and 0 seconds, respectively.

When the amount of droplets attached on the first face is relatively small, the drying time of liquid droplets may not be needed. Accordingly, without executing pause control, the image controller 310 may proceed to print the second face. Thus, an unnecessary pause control is omitted, thereby increasing the throughput of the duplex printing in the image forming apparatus 1.

As described above, the image forming apparatus 1 is provided with a control mechanism to execute charging control on the conveyance belt 31 during printing of the second face of the sheet 5 and execute pause control on the conveyance of the sheet 5 when the printing of the second face is finished. Thus, the image forming apparatus 1 may increase throughput of the duplex printing while suppressing attachment of liquid mist to the sheet 5.

Figure 10:
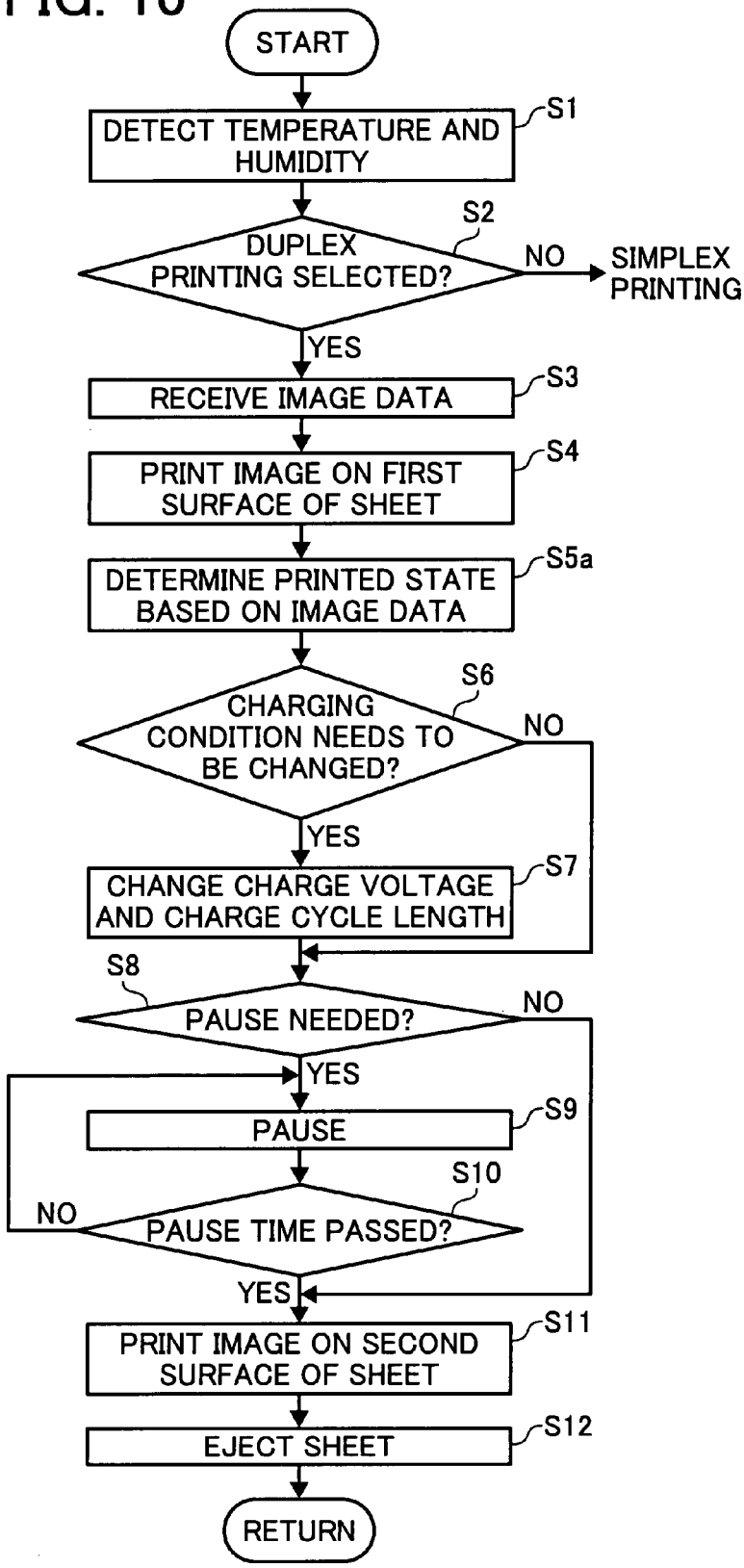
FIG. 10 is another flow chart illustrating a control operation executed by a main controller employed in an image forming apparatus according to another exemplary embodiment of the present disclosure.

Next, another exemplary embodiment of the present disclosure is described with reference to FIG. 10. FIG. 10 is another flow chart illustrating a control operation executed by a main controller 310 according to said another exemplary embodiment.

As illustrated in FIG. 10, the main controller 310 executes the control operation in a similar manner to the control operation of FIG. 9 except for step S5*a*.

At step S5*a*, the main controller 310 determines a printed state of a first face of a sheet 5 based on image data of an image formed on the first face. Such data used to determine the printed state of the first face can include print area size, print distribution such as the number of sequential ejection times of droplets, and print density such as density setting and number of overlay printing times for each print mode.

Further, similar to the operation flow of FIG. 9, the main controller 310 determines at step S6 whether or not the condition of the charging control on the conveyance belt 31 needs to be changed, and determines at step S8 whether or not pause control is needed after the printing of the first face.

For example, if the print area size on the first face is less than 30% of the total printable area of the first face of a sheet 5, the main controller 310 conveys the sheet 5 to the duplex unit 10 to execute the printing of the second face without executing pause control after printing an image on the first face.

In the above-described exemplary embodiments, any of the number of droplets ejected from the recording head assembly 24, the amount of droplets attached on the sheet 5, the print area size, the print distribution, and the print density can be used as parameters to change the conditions of the charging control and/or pause control of the main controller 310. In addition, two or more parameters may be used in combination to change the conditions of the charging control and/or pause control.

Further, a resistance detection sensor 215, indicated by a dash double-dotted line in FIG. 4, may be provided on an upstream side of the pair of registration rollers 44 in the sheet conveyance direction in order to measure a resistance value of the sheet 5 in a direct manner. In this case, based on a decreasing rate obtained by comparing resistance values of the sheet 5 before and after printing, the main controller 310 may determine whether or not the condition of the charging control needs to be changed, or whether or not the pause control should be executed.

Further, different criteria of the above described parameters may be set for different types of sheet. Thus, in response to the type of sheet, the main controller 310 may determine whether or not the condition of the charging control needs to be changed, or whether or not the pause control should be executed.

Embodiments of the present disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present disclosure may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that, within the scope of the appended claims, the subject matter of this disclosure may be practiced otherwise than as specifically described herein.

Further, elements and/or features of different embodiments and/or examples may be combined with each other and/or substituted for each other within the scope of this disclosure and appended claims.

Still further, any one of the above-described and other exemplary features of the present disclosure may be embodied in the form of an apparatus, method, system, computer program or computer program product. For example, the aforementioned methods may be embodied in the form of a system or device, including, but not limited to, any of the structures for performing the methodology illustrated in the drawings.

Even further, any of the aforementioned methods may be embodied in the form of a program. The program may be stored on a computer readable medium and configured to perform any one of the aforementioned methods when run on a computer device (a device including a processor). Thus, the storage medium or computer readable medium can be configured to store information and interact with a data processing facility or computer device to perform the method of any of the above-described embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media (such as CD-ROMs and DVDs), magneto-optical storage media (such as MOs), magnetic storage media (including but not limited to diskettes cassette tapes, and removable hard disks), media with a built-in rewriteable non-volatile memory (including but not limited to memory cards), and media with a built-in ROM (including but not limited to ROM cassettes), etc. Furthermore, various information regarding stored images, for example, property information, may be stored in any other form, or provided in other ways.

Examples and embodiments being thus described, it should be obvious apparent to one skilled in the art after reading this disclosure that the examples and embodiments may be varied in many ways. Such variations are not to be regarded as a departure from the spirit and scope of the present disclosure, and such modifications are not excluded from the scope of the following claims.

This disclosure claims priority under 35 U.S.C. §119 of Japanese Patent Application No. 2006-247755 filed on Sep. 13, 2006 in the Japan Patent Office, the entire contents of which are hereby incorporated herein by reference.

What is claimed is:

1. An image forming apparatus operable in a duplex printing mode, the image forming apparatus comprising:

a liquid ejecting head configured to eject liquid droplets to respective first and second faces of a recording medium to form images on the respective first and second faces of the recording medium in order of the first face and then the second face;

a conveyance member configured to convey the recording medium while attracting the recording medium by an electrostatic force to a surface of the conveyance member;

a charger configured to conduct a charging operation of the conveyance member to generate the electrostatic force for attracting the recording medium on the conveyance member; and a controller configured to control, based on a state of the first face having the image formed thereon, the charging operation for generating the electrostatic force in the conveyance member during an image formation on the second face, and control a pause operation of a conveyance of the recording medium after the image formation on the first face, wherein the controller determines the state of the first face having the image formed thereon, based on, at least in part, an estimate of an amount of droplets attached on the first face, determined based on a count of a number of the liquid droplets ejected by the liquid ejecting head towards the first face of the recording medium, wherein the controller determines, based on the state of the first face having the image formed thereon, whether or not charging control to be executed when the charger charges the conveyance member needs to be changed in printing the second face, wherein the controller adjusts a length of charge cycle of the charger, if the controller determines that the charging control needs to be changed, wherein in a case in which the amount of droplets attached on the first face having the image formed thereon is smaller than a threshold value, the controller extends the length of the charge cycle without pausing the conveyance of the recording medium, and in a case in which the amount of droplets attached on the first face is greater than the threshold value, the controller extends the length of the charge cycle and causes the conveyance of the recording medium to be paused.

2. The image forming apparatus according to claim 1, wherein the controller refers to an area of the image on the first face as the state of the first face.

3. The image forming apparatus according to claim 1, wherein the controller refers to a distribution of the liquid droplets on the first face as the state of the first face.

4. The image forming apparatus according to claim 1, wherein the controller refers to a density of the liquid droplets on the first face as the state of the first face.

5. The image forming apparatus according to claim 1, wherein the controller refers to image data used for forming the image on the first face to determine the state of the first face.

6. The image forming apparatus according to claim 1, wherein the controller refers to a resistance value of the recording medium as the state of the first face.

7. The image forming apparatus according to claim 1, wherein the controller refers to a resistance value set in accordance with a type of the recording medium as the state of the first face.

8. The image forming apparatus according to claim 1, wherein the controller is further configured to adjust a charge potential of the charger.

9. A method of forming an image on a recording medium, the method comprising:

ejecting liquid droplets to respective first and second faces of a recording medium to form images on the respective first and second faces of the recording medium in order of the first face and the second face;

conveying the recording medium while attracting the recording medium on a conveyance member by an electrostatic force;

charging the conveyance member to generate the electrostatic force for attracting the recording medium on the conveyance member;

controlling, based on a state of the first face having the image formed thereon, the charging operation for generating the electrostatic force in the conveyance member during an image formation on the second face, and a pause operation of a conveyance of the recording medium after the image formation on the first face;

determining the state of the first face having the image formed thereon, based on, at least in part, an estimate of an amount of droplets attached on the first face, determined based on a count of a number of the liquid droplets ejected by the liquid ejecting head towards the first face of the recording medium;

determining, based on the state of the first face having the image formed thereon, whether or not charging control to be executed when the charger charges the conveyance member needs to be changed in printing the second face; and adjusting a length of charge cycle of the charger, if it is determined that the charging control needs to be changed, wherein in a case in which the amount of droplets attached on the first face having the image formed thereon is smaller than a threshold value, the length of the charge cycle is extended without pausing the conveyance of the recording medium, and in a case in which the amount of droplets attached on the first face is greater than the threshold value, the length of the charge cycle is extended and the conveyance of the recording medium is paused.

10. The method according to claim 9, wherein the controlling further includes referring to image data used for forming an image on the first face to determine the state of the first face.

11. The method according to claim 9, wherein the controlling further includes referring to a resistance value of the recording medium as the state of the first face.

12. The method according to claim 9, wherein the controlling further includes adjusting a charge potential of the charger.

13. The image forming apparatus according to claim 1, wherein the controller controls charging of the first and second faces so that an electrostatic force of the conveyance member in the printing of the second face is greater than an electrostatic force of the conveyance member in the printing of the first face.

14. The image forming apparatus according to claim 1, wherein the charger includes a charging roller, and the image forming apparatus further comprises a high-voltage power source supplying a high alternating voltage to the charging roller, wherein the charging roller receiving the high alternating voltage functions as a charging unit to charge a surface of the conveyance member, wherein the controller controls the conveyance member and controls the high-voltage power source to apply a specific charging cycle of positive and negative polarities to the charging roller.

15. The image forming apparatus according to claim 1, further comprising a duplex unit configured to switch an orientation of the recording medium for printing on the second face of the recording medium, wherein the controller determines, based on the amount of droplets attached on the first face, whether or not pause control for pausing the conveyance of the recording medium is needed, and if the controller determines that the pause control is needed, the controller causes conveyance of the recording medium to be paused, and keeps the recording medium in a standby state for a specific pause time, and after the specific pause time passes, the controller causes the recording medium to be supplied to the duplex unit, and causes printing to be performed on the second face of the recording medium.

16. The image forming apparatus according to claim 1, wherein the specific pause time is based on ambient temperature and humidity and the amount of droplets attached on the first face.

17. The image forming apparatus according to claim 1, wherein the controller adjusts the charge cycle length based on humidity.

18. The image forming apparatus according to claim 1, wherein the controller controls the charger to adjust the length of the charge cycle of the charger, if the controller determines that the charging control needs to be changed.

19. The image forming apparatus according to claim 1, further comprising:

a recording medium ejecting unit disposed downstream of the conveyance member in a conveyance direction, and configured to eject the recording medium after the image formed has been formed on the first face, the recording medium ejecting unit including a plurality of conveyance rollers and a plurality of spurs facing the plurality of respective conveyance rollers.

* * * * *